US008350761B2

(12) United States Patent
Hill et al.

(10) Patent No.: US 8,350,761 B2
(45) Date of Patent: Jan. 8, 2013

(54) ANTENNAS FOR HANDHELD ELECTRONIC DEVICES

(75) Inventors: Robert J. Hill, Salinas, CA (US); Robert W. Schlub, Campbell, CA (US); Juan Zavala, Watsonville, CA (US); Ruben Caballero, San Jose, CA (US)

(73) Assignee: Apple Inc., Cupertino, CA (US)

( * ) Notice: Subject to any disclaimer, the term of this patent is extended or adjusted under 35 U.S.C. 154(b) by 1087 days.

(21) Appl. No.: 11/650,187

(22) Filed: Jan. 4, 2007

(65) Prior Publication Data

US 2008/0165065 A1 Jul. 10, 2008

(51) Int. Cl.
*H01Q 1/24* (2006.01)
*H01Q 1/38* (2006.01)

(52) U.S. Cl. ..... 343/702; 343/767; 343/846; 455/575.7

(58) Field of Classification Search ..... 343/700 MS, 343/702, 767, 846; 455/575.7
See application file for complete search history.

(56) References Cited

U.S. PATENT DOCUMENTS

| | | | | |
|---|---|---|---|---|
| 2,947,987 | A | 8/1960 | Dodington | |
| 4,641,366 | A | 2/1987 | Yokoyama et al. | |
| 4,853,704 | A * | 8/1989 | Diaz et al. | 343/767 |
| 4,894,663 | A | 1/1990 | Urbish et al. | |
| 4,980,694 | A | 12/1990 | Hines | |
| 4,987,421 | A * | 1/1991 | Sunahara et al. | 343/700 MS |
| 5,021,010 | A | 6/1991 | Wright | |
| 5,041,838 | A | 8/1991 | Liimatainen et al. | |
| 5,048,118 | A | 9/1991 | Brooks et al. | |
| 5,561,437 | A | 10/1996 | Phillips et al. | |
| 5,754,143 | A | 5/1998 | Warnagiris et al. | |
| 5,798,984 | A | 8/1998 | Koch | |
| 6,011,699 | A | 1/2000 | Murray et al. | |
| 6,097,345 | A | 8/2000 | Walton et al. | |
| 6,140,966 | A | 10/2000 | Pankinaho | |
| 6,184,845 | B1 | 2/2001 | Leisten et al. | |
| 6,191,740 | B1 * | 2/2001 | Kates et al. | 343/700 MS |

(Continued)

FOREIGN PATENT DOCUMENTS

CN 1460310 12/2003

(Continued)

OTHER PUBLICATIONS

Hobson et al. U.S. Appl. No. 60/883,587, filed Jan. 5, 2007.

(Continued)

*Primary Examiner* — Michael C Wimer
(74) *Attorney, Agent, or Firm* — Treyz Law Group; G. Victor Treyz; Chih-Yun Wu

(57) ABSTRACT

Handheld electronic devices are provided that contain wireless communications circuitry having at least one antenna. The antenna may have a planar ground element and a planar resonating element. The planar ground element may have a rectangular shape that matches a rectangular housing shape for a handheld electronic device. A dielectric-filled slot may be formed in one end of the planar ground element. The planar resonating element may be located above the slot. The antenna may be a hybrid antenna that contains both a slot antenna structure formed from the slot and a planar inverted-F structure formed from the planar resonating element and the planar ground element. The antenna may be fed using a single transmission line or two transmission lines. With two transmission lines, one transmission line may be associated with the slot antenna structure and one transmission line may be associated with the planar inverted-F antenna structure.

24 Claims, 11 Drawing Sheets

U.S. PATENT DOCUMENTS

| | | | | |
|---|---|---|---|---|
| 6,337,662 | B1 | 1/2002 | Cassel | |
| 6,339,400 | B1 | 1/2002 | Flint et al. | |
| 6,346,914 | B1 | 2/2002 | Annamaa | |
| 6,348,894 | B1 | 2/2002 | Lahti | |
| 6,384,696 | B1 | 5/2002 | Miller et al. | |
| 6,404,394 | B1 * | 6/2002 | Hill | 343/702 |
| 6,424,300 | B1 | 7/2002 | Sanford et al. | |
| 6,567,053 | B1 | 5/2003 | Yablonovitch et al. | |
| 6,573,869 | B2 | 6/2003 | Moore | |
| 6,622,031 | B1 | 9/2003 | McCleary et al. | |
| 6,624,789 | B1 | 9/2003 | Kangasvieri et al. | |
| 6,670,923 | B1 | 12/2003 | Kadambi et al. | |
| 6,741,214 | B1 | 5/2004 | Kadambi et al. | |
| 6,747,601 | B2 | 6/2004 | Boyle | |
| 6,831,607 | B2 | 12/2004 | Hebron et al. | |
| 6,856,294 | B2 | 2/2005 | Kadambi et al. | |
| 6,882,317 | B2 | 4/2005 | Koskiniemi et al. | |
| 6,968,508 | B2 | 11/2005 | Lucaci et al. | |
| 6,980,154 | B2 | 12/2005 | Vance et al. | |
| 7,027,838 | B2 | 4/2006 | Zhou et al. | |
| 7,053,841 | B2 * | 5/2006 | Ponce De Leon et al. | 343/702 |
| 7,053,852 | B2 | 5/2006 | Timofeev et al. | |
| 7,116,267 | B2 | 10/2006 | Schuster et al. | |
| 7,119,747 | B2 | 10/2006 | Lin et al. | |
| 7,123,208 | B2 | 10/2006 | Baliarda et al. | |
| 7,202,826 | B2 | 4/2007 | Grant et al. | |
| 7,289,068 | B2 | 10/2007 | Fujio et al. | |
| 7,403,164 | B2 | 7/2008 | Sanz et al. | |
| 7,443,810 | B2 | 10/2008 | Boyle | |
| 7,535,422 | B2 | 5/2009 | Liu et al. | |
| 7,595,759 | B2 | 9/2009 | Schlub et al. | |
| 7,612,725 | B2 | 11/2009 | Hill et al. | |
| 7,768,462 | B2 | 8/2010 | Zhang et al. | |
| 7,808,438 | B2 | 10/2010 | Schlub et al. | |
| 7,848,771 | B2 * | 12/2010 | Boyle | 455/550.1 |
| 7,864,123 | B2 | 1/2011 | Hill et al. | |
| 7,893,883 | B2 | 2/2011 | Schlub et al. | |
| 7,898,485 | B2 | 3/2011 | Schlub et al. | |
| 7,911,387 | B2 | 3/2011 | Hill et al. | |
| 2001/0052877 | A1 | 12/2001 | Honda et al. | |
| 2003/0098813 | A1 | 5/2003 | Koskiniemi et al. | |
| 2003/0107518 | A1 | 6/2003 | Li et al. | |
| 2003/0119457 | A1 | 6/2003 | Standke | |
| 2003/0189525 | A1 | 10/2003 | Tan et al. | |
| 2004/0017318 | A1 | 1/2004 | Annabi et al. | |
| 2004/0058723 | A1 | 3/2004 | Mikkola et al. | |
| 2004/0137950 | A1 | 7/2004 | Bolin et al. | |
| 2004/0145521 | A1 | 7/2004 | Hebron et al. | |
| 2006/0038736 | A1 | 2/2006 | Ping et al. | |
| 2006/0055606 | A1 | 3/2006 | Boyle | |
| 2007/0018895 | A1 | 1/2007 | Bolin | |
| 2007/0030200 | A1 | 2/2007 | Heng et al. | |
| 2008/0013011 | A1 | 1/2008 | Hiratsuka et al. | |
| 2008/0231521 | A1 | 9/2008 | Anguera Pros et al. | |
| 2009/0040115 | A1 | 2/2009 | Zhang et al. | |
| 2009/0256759 | A1 | 10/2009 | Hill et al. | |
| 2009/0303139 | A1 | 12/2009 | Schlub et al. | |
| 2010/0007564 | A1 | 1/2010 | Hill et al. | |

FOREIGN PATENT DOCUMENTS

| | | | |
|---|---|---|---|
| CN | 1495966 | | 5/2004 |
| CN | 1630962 | | 6/2005 |
| CN | 1672289 | | 9/2005 |
| CN | 1691415 | | 11/2005 |
| CN | 101032051 | | 9/2007 |
| EP | 0 851 530 | | 7/1998 |
| EP | 1 315 238 | | 7/2003 |
| EP | 1 351 334 | A | 10/2003 |
| EP | 1351334 | | 10/2003 |
| EP | 1 401 050 | A | 3/2004 |
| EP | 1401050 | | 3/2004 |
| GB | 2 301 485 | | 12/1996 |
| JP | 09-093031 | | 4/1997 |
| JP | 2002-538648 | | 8/2000 |
| JP | 2003-124730 | | 4/2003 |
| TW | 200537746 | | 11/2005 |
| TW | 200640075 | | 11/2006 |
| WO | 00-51201 | | 8/2000 |
| WO | 02/078123 | | 10/2002 |
| WO | 2006/114771 | | 10/2002 |
| WO | 2004/001894 | A | 12/2003 |
| WO | 2004/038857 | | 5/2004 |
| WO | 2004/102744 | | 11/2004 |
| WO | 2004102744 | | 11/2004 |
| WO | 2005/109567 | A | 11/2005 |
| WO | 2006/070017 | | 7/2006 |
| WO | 2006/097496 | | 9/2006 |

OTHER PUBLICATIONS

Schlub et al. U.S. Appl. No. 13/092,875, filed Apr. 22, 2011.

* cited by examiner

ANTENNAS FOR HANDHELD ELECTRONIC DEVICES

BACKGROUND

This invention relates generally to wireless communications circuitry, and more particularly, to wireless communications circuitry for handheld electronic devices.

Handheld electronic devices are becoming increasingly popular. Examples of handheld devices include handheld computers, cellular telephones, media players, and hybrid devices that include the functionality of multiple devices of this type.

Due in part to their mobile nature, handheld electronic devices are often provided with wireless communications capabilities. Handheld electronic devices may use long-range wireless communications to communicate with wireless base stations. For example, cellular telephones may communicate using cellular telephone bands at 850 MHz, 900 MHz, 1800 MHz, and 1900 MHz (e.g., the main Global System for Mobile Communications or GSM cellular telephone bands). Handheld electronic devices may also use short-range wireless communications links. For example, handheld electronic devices may communicate using the WiFi® (IEEE 802.11) band at 2.4 GHz and the Bluetooth® band at 2.4 GHz.

To satisfy consumer demand for small form factor wireless devices, manufacturers are continually striving to reduce the size of components that are used in these devices. For example, manufacturers have made attempts to miniaturize the antennas used in handheld electronic devices.

A typical antenna may be fabricated by patterning a metal layer on a circuit board substrate or may be formed from a sheet of thin metal using a foil stamping process. Many devices use planar inverted-F antennas (PIFAs). Planar inverted-F antennas are formed by locating a planar resonating element above a ground plane. These techniques can be used to produce antennas that fit within the tight confines of a compact handheld device.

Although modern handheld electronic devices often need to function over a number of different communications bands, it is difficult to design a compact antenna that functions satisfactorily over a wide frequency range with satisfactory performance levels. For example, when the vertical size of conventional planar inverted-F antennas is made too small in an attempt to minimize antenna size, the bandwidth and gain of the antenna are adversely affected.

It would therefore be desirable to be able to provide improved antennas and wireless handheld electronic devices.

SUMMARY

In accordance with an embodiment of the present invention, a handheld electronic device with wireless communications circuitry is provided. The handheld electronic device may have cellular telephone, music player, or handheld computer functionality. The wireless communications circuitry may have at least one antenna.

The handheld electronic device may have lateral dimensions that define a rectangular housing. The antenna may have a ground plane element and a resonating element. The ground plane element of the antenna may be rectangular and may have lateral dimensions that match those of the handheld electronic device. A rectangular slot may be formed in one end of the ground plane element. The resonating element may be located directly above the slot. Because the slot reduces electromagnetic near-field coupling between the resonating element and the ground plane, the height of the antenna above the ground plane may be reduced without adversely affecting antenna performance, thereby allowing the thickness of the handheld electronic device to be minimized.

The antenna may operate in a hybrid mode in which the antenna displays characteristics of both a slot antenna and a planar inverted-F antenna. The planar inverted-F antenna characteristics of the antenna may be obtained by using an antenna feed arrangement in which an antenna ground terminal is connected to the ground plane and an antenna signal terminal is connected to the resonating element through a feed conductor or other suitable feed path. The slot antenna characteristics of the antenna may be obtained using an antenna feed arrangement having a ground terminal connected to the ground plane in the vicinity of the slot and a signal terminal connected to the ground plane in the vicinity of the slot. The ground terminal used for driving the antenna so that it exhibits planar inverted-F antenna characteristics need not be the same as the ground terminal used for driving the antenna so that it exhibits slot antenna characteristics.

With one feed arrangement, separate coaxial cables or other suitable transmission lines are used to convey signals to the slot antenna portion and the planar inverted-F antenna portion of the antenna. In this type of arrangement, a first transmission line has a ground conductor and a signal conductor that are connected to the ground plane and the resonating element, respectively. The first transmission line is associated with the planar inverted-F antenna operating characteristics of the antenna. A second transmission line has a ground conductor that is connected to the ground plane at a location that is different than the location at which the ground conductor of the first transmission line is connected. The second transmission line also has a signal conductor that is connected to the ground plane. The second transmission line is associated with the slot antenna operating characteristics of the antenna.

With another feed arrangement, a single coaxial cable or other suitable transmission line is used to convey signals simultaneously to the slot antenna portion and the planar inverted-F antenna portion of the antenna. In this type of arrangement, the transmission line has a ground conductor and a signal conductor that are connected to the ground plane and the resonating element, respectively. A conductive path connects the signal conductor to the ground plane at a location that is different than the location at which the ground conductor is connected to the ground plane.

Further features of the invention, its nature and various advantages will be more apparent from the accompanying drawings and the following detailed description of the preferred embodiments.

DETAILED DESCRIPTION

The present invention relates generally to wireless communications, and more particularly, to wireless electronic devices and antennas for wireless electronic devices.

The antennas may be small form factor antennas that exhibit wide bandwidths and large gains.

The wireless electronic devices may be portable electronic devices such as laptop computers or small portable computers of the type that are sometimes referred to as ultraportables. Portable electronic devices may also be somewhat smaller devices. Examples of smaller portable electronic devices include wrist-watch devices, pendant devices, headphone and earpiece devices, and other wearable and miniature devices.

With one suitable arrangement, the portable electronic devices are handheld electronic devices. Space is at a premium in handheld electronics devices, so high-performance compact antennas can be particularly advantageous in such devices. The use of handheld devices is therefore generally described herein as an example, although any suitable electronic device may be used with the high-performance compact antennas of the invention if desired.

The handheld devices may be, for example, cellular telephones, media players with wireless communications capabilities, handheld computers (also sometimes called personal digital assistants), remote controllers, global positioning system (GPS) devices, and handheld gaming devices. The handheld devices may also be hybrid devices that combine the functionality of multiple conventional devices. Examples of hybrid handheld devices include a cellular telephone that includes media player functionality, a gaming device that includes a wireless communications capability, a cellular telephone that includes game and email functions, and a handheld device that receives email, supports mobile telephone calls, and supports web browsing. These are merely illustrative examples.

Figure 1:
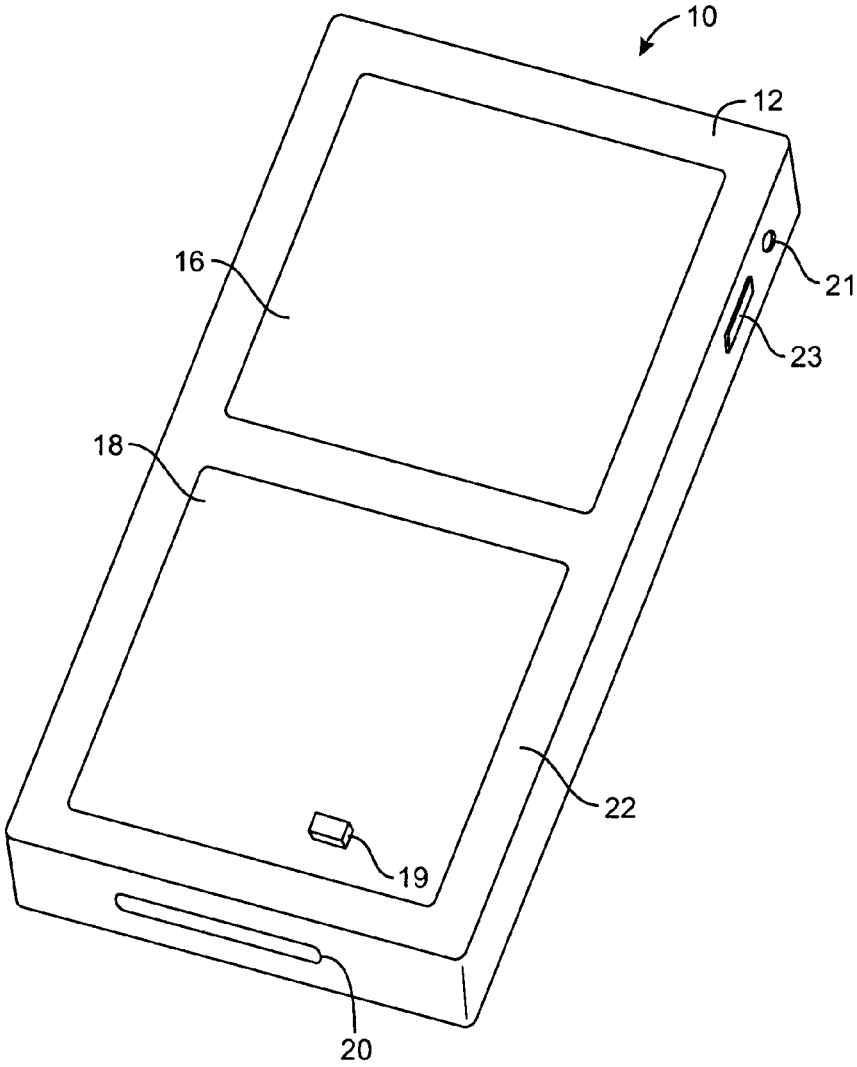
FIG. 1 is a perspective view of an illustrative handheld electronic device with an antenna in accordance with an embodiment of the present invention.

An illustrative handheld electronic device in accordance with an embodiment of the present invention is shown in FIG. 1. Device 10 may be any suitable portable or handheld electronic device.

Device 10 includes housing 12 and includes at least one antenna for handling wireless communications. Housing 12, which is sometimes referred to as a case, may be formed of any suitable materials including, plastic, glass, ceramics, metal, or other suitable materials, or a combination of these materials. In some situations, case 12 may be formed from a dielectric or other low-conductivity material, so that the operation of conductive antenna elements that are located in proximity to case 12 is not disrupted. In other situations, case 12 may be formed from metal elements. In scenarios in which case 12 is formed from metal elements, one or more of the metal elements may be used as part of the antenna(s) in device 10. For example, the rear of case 12 may be shorted to an internal ground plane in device 10 to create an effectively larger ground plane element for that device 10.

Handheld electronic device 10 may have input-output devices such as a display screen 16, buttons such as button 23, user input control devices 18 such as button 19, and input-output components such as port 20 and input-output jack 21. Display screen 16 may be, for example, a liquid crystal display (LCD), an organic light-emitting diode (OLED) display, a plasma display, or multiple displays that use one or more different display technologies. As shown in the example of FIG. 1, display screens such as display screen 16 can be mounted on front face 22 of handheld electronic device 10. If desired, displays such as display 16 can be mounted on the rear face of handheld electronic device 10, on a side of device 10, on a flip-up portion of device 10 that is attached to a main body portion of device 10 by a hinge (for example), or using any other suitable mounting arrangement.

A user of handheld device 10 may supply input commands using user input interface 18. User input interface 18 may include buttons (e.g., alphanumeric keys, power on-off, power-on, power-off, and other specialized buttons, etc.), a touch pad, pointing stick, or other cursor control device, a touch screen (e.g., a touch screen implemented as part of screen 16), or any other suitable interface for controlling device 10. Although shown schematically as being formed on the top face 22 of handheld electronic device 10 in the example of FIG. 1, user input interface 18 may generally be formed on any suitable portion of handheld electronic device 10. For example, a button such as button 23 (which may be considered to be part of input interface 18) or other user interface control may be formed on the side of handheld electronic device 10. Buttons and other user interface controls can also be located on the top face, rear face, or other portion of device 10. If desired, device 10 can be controlled remotely (e.g., using an infrared remote control, a radio-frequency remote control such as a Bluetooth remote control, etc.).

Handheld device 10 may have ports such as bus connector 20 and jack 21 that allow device 10 to interface with external components. Typical ports include power jacks to recharge a battery within device 10 or to operate device 10 from a direct current (DC) power supply, data ports to exchange data with external components such as a personal computer or peripheral, audio-visual jacks to drive headphones, a monitor, or other external audio-video equipment, etc. The functions of some or all of these devices and the internal circuitry of handheld electronic device 10 can be controlled using input interface 18.

Components such as display 16 and user input interface 18 may cover most of the available surface area on the front face 22 of device 10 (as shown in the example of FIG. 1) or may occupy only a small portion of the front face 22. Because electronic components such as display 16 often contain large amounts of metal (e.g., as radio-frequency shielding), the location of these components relative to the antenna elements in device 10 should generally be taken into consideration. Suitably chosen locations for the antenna elements and electronic components of the device will allow the antenna of handheld electronic device 10 to function properly without being disrupted by the electronic components. With one suitable arrangement, the antenna of device 10 is located in the lower end of device 10, in the proximity of port 20. An advantage of locating antenna in the lower portion of housing 12 and device 10 is that this places the antenna away from the user's head when the device 10 is held to the head (e.g., when talking into a microphone and listening to a speaker in the handheld device as with a cellular telephone). This reduces the amount of radio-frequency radiation that is emitted in the vicinity of the user and minimizes proximity effects.

Figure 2:
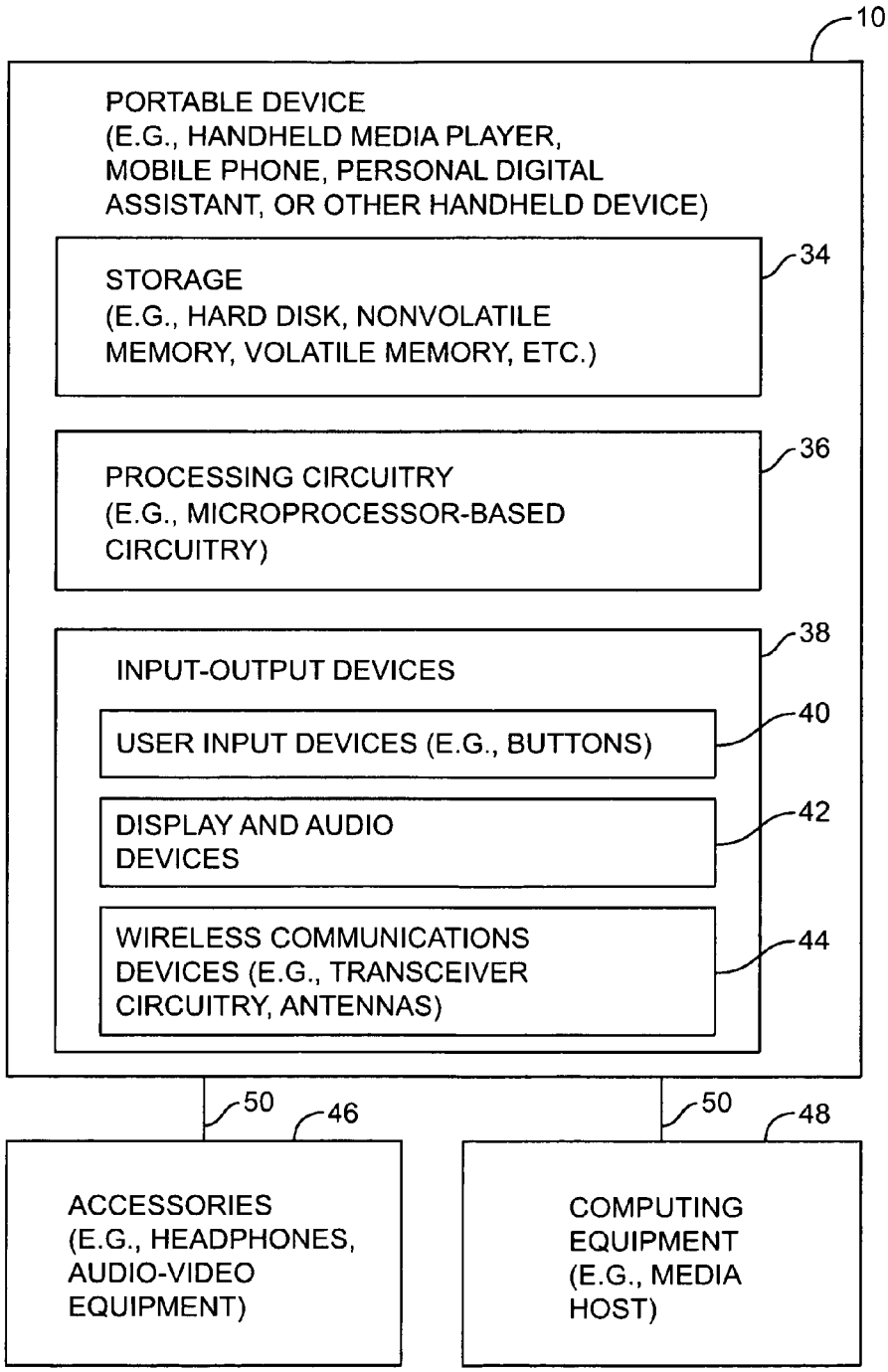
FIG. 2 is a schematic diagram of an illustrative handheld electronic device with an antenna in accordance with an embodiment of the present invention.

A schematic diagram of an embodiment of an illustrative handheld electronic device is shown in FIG. 2. Handheld device 10 may be a mobile telephone, a mobile telephone with media player capabilities, a handheld computer, a remote control, a game player, a global positioning system (GPS) device, a combination of such devices, or any other suitable portable electronic device.

As shown in FIG. 2, handheld device 10 may include storage 34. Storage 34 may include one or more different types of storage such as hard disk drive storage, nonvolatile memory (e.g., flash memory or other electrically-programmable-read-only memory), volatile memory (e.g., battery-based static or dynamic random-access-memory), etc.

Processing circuitry 36 may be used to control the operation of device 10. Processing circuitry 36 may be based on a processor such as a microprocessor and other suitable integrated circuits. With one suitable arrangement, processing circuitry 36 and storage 34 are used to run software on device 10, such as internet browsing applications, voice-over-internet-protocol (VOIP) telephone call applications, email applications, media playback applications, operating system functions, etc. Processing circuitry 36 and storage 34 may be used in implementing suitable communications protocols. Communications protocols that may be implemented using processing circuitry 36 and storage 34 include internet protocols, wireless local area network protocols (e.g., IEEE 802.11 protocols—sometimes referred to as WiFi®, protocols for other short-range wireless communications links such as the Bluetooth® protocol, etc.).

Input-output devices 38 may be used to allow data to be supplied to device 10 and to allow data to be provided from device 10 to external devices. Display screen 16 and user input interface 18 of FIG. 1 are examples of input-output devices 38.

Input-output devices 38 can include user input-output devices 40 such as buttons, touch screens, joysticks, click wheels, scrolling wheels, touch pads, key pads, keyboards, microphones, cameras, etc. A user can control the operation of device 10 by supplying commands through user input devices 40. Display and audio devices 42 may include liquid-crystal display (LCD) screens, light-emitting diodes (LEDs), and other components that present visual information and status data. Display and audio devices 42 may also include audio equipment such as speakers and other devices for creating sound. Display and audio devices 42 may contain audio-video interface equipment such as jacks and other connectors for external headphones and monitors.

Wireless communications devices 44 may include communications circuitry such as radio-frequency (RF) transceiver circuitry formed from one or more integrated circuits, power amplifier circuitry, passive RF components, one or more antennas, and other circuitry for handling RF wireless signals. Wireless signals can also be sent using light (e.g., using infrared communications).

Device 10 can communicate with external devices such as accessories 46 and computing equipment 48, as shown by paths 50. Paths 50 may include wired and wireless paths. Accessories 46 may include headphones (e.g., a wireless cellular headset or audio headphones) and audio-video equipment (e.g., wireless speakers, a game controller, or other equipment that receives and plays audio and video content).

Computing equipment 48 may be any suitable computer. With one suitable arrangement, computing equipment 48 is a computer that has an associated wireless access point (router) or an internal or external wireless card that establishes a wireless connection with device 10. The computer may be a server (e.g., an internet server), a local area network computer with or without internet access, a user's own personal computer, a peer device (e.g., another handheld electronic device 10), or any other suitable computing equipment.

The antenna(s) and wireless communications devices of device 10 may support communications over any suitable wireless communications bands. For example, wireless communications devices 44 may be used to cover communications frequency bands such as the cellular telephone bands at 850 MHz, 900 MHz, 1800 MHz, and 1900 MHz, data service bands such as the 3G data communications band at 2170 MHz band (commonly referred to as UMTS or Universal Mobile Telecommunications System), the WiFi® (IEEE 802.11) bands at 2.4 GHz and 5.0 GHz, the Bluetooth® band at 2.4 GHz, and the global positioning system (GPS) band at 1550 MHz. These are merely illustrative communications bands over which devices 44 may operate. Additional local and remote communications bands are expected to be deployed in the future as new wireless services are made available. Wireless devices 44 may be configured to operate over any suitable band or bands to cover any existing or new services of interest. If desired, multiple antennas and/or a broadband antenna may be provided in wireless devices 44 to allow coverage of more bands.

Figure 3:
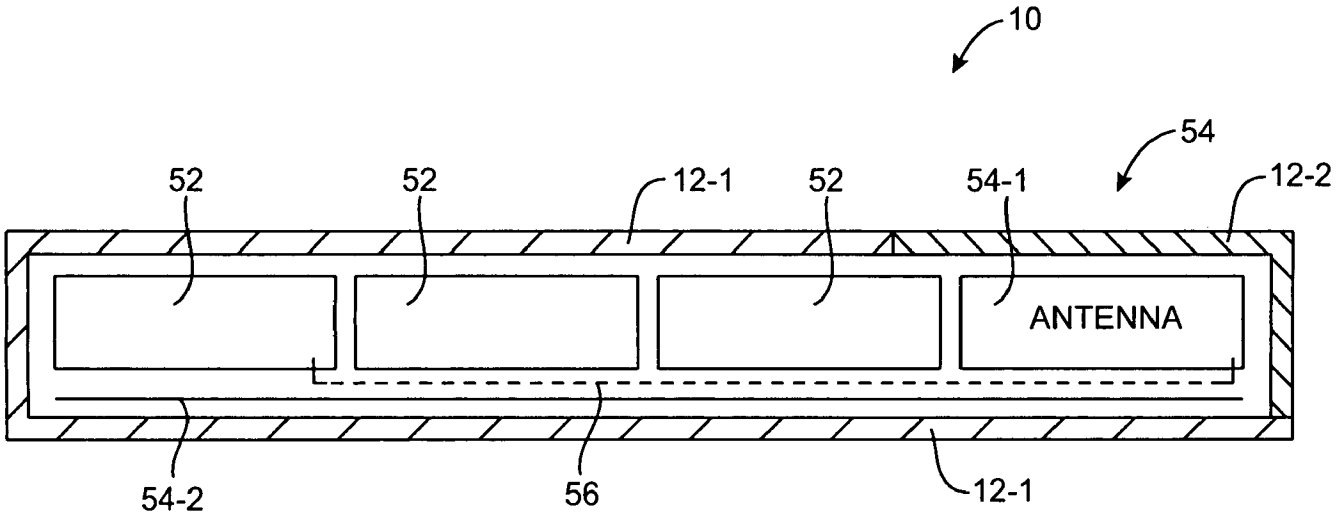
FIG. 3 is a cross-sectional side view of an illustrative handheld electronic device with an antenna in accordance with an embodiment of the present invention.

A cross-sectional view of an illustrative handheld electronic device is shown in FIG. 3. In the example of FIG. 3, device 10 has a housing that is formed of a conductive portion 12-1 and a plastic portion 12-2. Conductive portion 12-1 may be any suitable conductor. With one suitable arrangement, case portion 12-1 is formed from stamped 304 stainless steel. Stainless steel has a high conductivity and can be polished to a high-gloss finish so that it has an attractive appearance. If desired, other metals can be used for case portion 12-1 such as aluminum, magnesium, alloys of these metals and other metals, etc.

Housing portion 12-2 may be formed from a dielectric. An advantage of using dielectric for housing portion 12-2 is that this allows a resonating element portion 54-1 of antenna 54 of device 10 to operate without interference from the metal sidewalls of housing 12. With one suitable arrangement, housing portion 12-2 is a plastic cap formed from a plastic based on acrylonitrile-butadiene-styrene copolymers (sometimes referred to as ABS plastic). These are merely illustrative housing materials for device 10. For example, the housing of device 10 may be formed substantially from plastic or other dielectrics, substantially from metal or other conductors, or from any other suitable materials or combinations of materials.

Components such as components 52 may be mounted on one or more circuit boards in device 10. Typical components include integrated circuits, LCD screens, and user input interface buttons. Device 10 also typically includes a battery, which may be mounted along the rear face of housing 12 (as an example).

The circuit board(s) in device 10 may be formed from any suitable materials. With one suitable arrangement, device 10 is provided with a multilayer printed circuit board. At least one of the layers has large uninterrupted planar regions of conductor that form ground plane 54-2. In a typical scenario, ground plane 54-2 is a rectangle that conforms to the generally rectangular shape of housing 12 and device 10 and matches the rectangular lateral dimensions of housing 12. Ground plane 54-2 may, if desired, be electrically connected to conductive housing portion 12-1. Suitable circuit board materials for the multilayer printed circuit board include paper impregnated with phonolic resin, resins reinforced with glass fibers such as fiberglass mat impregnated with epoxy resin (sometimes referred to as FR-4), plastics, polytetrafluoroethylene, polystyrene, polyimide, and ceramics. Circuit boards fabricated from materials such as FR-4 are commonly available, are not cost-prohibitive, and can be fabricated with multiple layers of metal (e.g., four layers). So-called flex circuits, which are flexible circuit board materials such as polyimide, may also be used in device 10.

Ground plane element 54-2 and antenna resonating element 54-1 form antenna 54 for device 10. If desired, other antennas can be provided for device 10 in addition to antenna 54. Such additional antennas may, if desired, be configured to provide additional gain for an overlapping frequency band of interest (i.e., a band at which antenna 54 is operating) or may be used to provide coverage in a different frequency band of interest (i.e., a band outside of the range of antenna 54).

Any suitable conductive materials may be used to form ground plane element 54-2 and resonating element 54-1 in antenna 54. Examples of suitable conductive materials for antenna 54 include metals, such as copper, brass, silver, and gold. Conductors other than metals may also be used, if desired. The conductive elements in antenna 54 are typically thin (e.g., about 0.2 mm).

Components 52 include transceiver circuitry (see, e.g., devices 44 of FIG. 2). The transceiver circuitry may be provided in the form of one or more integrated circuits and associated discrete components (e.g., filtering components). Transceiver circuitry may include one or more transmitter integrated circuits, one or more receiver integrated circuits, switching circuitry, amplifiers, etc. In a typical scenario, the transceiver circuitry contains one or two transceivers, each of which has an associated coaxial cable or other transmission line over which radio frequency signals for antenna 54 are conveyed. In the example of FIG. 3, these transmission lines are depicted by dotted line 56.

As shown in FIG. 3, the transmission lines 56 may be used to distribute radio-frequency signals that are to be transmitted through the antenna from a transmitter integrated circuit 52 or other transceiver circuit to antenna 54. Paths 56 are also used to convey radio-frequency signals that have been received by antenna 54 to components 52. A receiver integrated circuit or other transceiver circuitry may be used to process incoming radio-frequency signals that have been conveyed from antenna 54 over one or more transmission lines 56.

Figure 4:
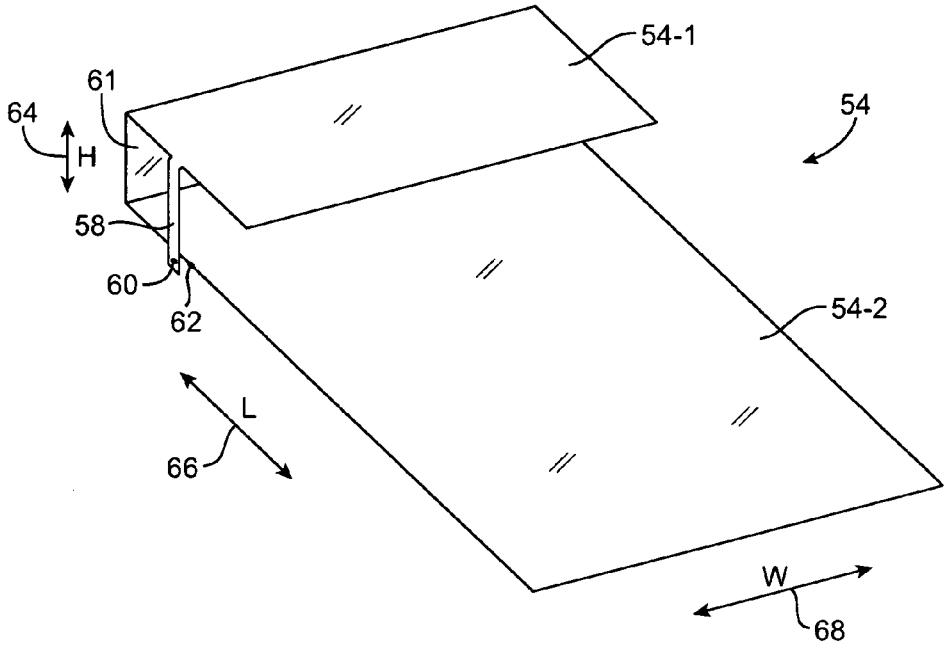
FIG. 4 is a perspective view of an illustrative planar inverted-F antenna in accordance with an embodiment of the present invention.

Antenna 54 may be formed in any suitable shape. With one suitable arrangement, antenna 54 is based at least partly on a planar inverted-F antenna (PIFA) structure. An illustrative PIFA structure that may be used for antenna 54 is shown in FIG. 4. As shown in FIG. 4, PIFA structure 54 has a ground plane portion 54-2 and a planar resonating element portion 54-1. Antennas are fed using positive signals and ground signals. The portion of an antenna to which the positive signal is provided is sometimes referred to as the antenna's positive terminal or feed terminal. This terminal is also sometimes referred to as the signal terminal or the center-conductor terminal. The portion of an antenna to which the ground signal is provided may be referred to as the antenna's ground, the antenna's ground terminal, the antenna's ground plane, etc. In antenna 54 of FIG. 4, feed conductor 58 is used to route positive antenna signals from signal terminal 60 into antenna resonating element 54-1. Ground terminal 62 is shorted to ground plane 54-2, which forms the antenna's ground.

The dimensions of antenna 54 are generally sized to conform to the maximum size allowed by housing 12 of device 10. Antenna ground plane 54-2 may be rectangular in shape having width W in lateral dimension 68 and length L in lateral dimension 66. The length of antenna 54 in dimension 66 affects its frequency of operation. Dimensions 68 and 66 are sometimes referred to as horizontal dimensions. Resonating element 54-1 is typically spaced several millimeters from ground plane 54-2 along vertical dimension 64. The size of antenna 54 in dimension 64 is sometimes referred to as height H of antenna 54.

Figure 5:
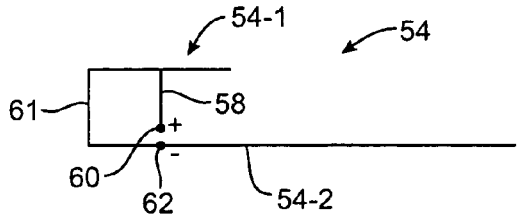
FIG. 5 is a cross-sectional side view of an illustrative planar inverted-F antenna (PIFA) in accordance with an embodiment of the present invention.

A cross-sectional view of antenna 54 is shown in FIG. 5. As shown in FIG. 5, radio-frequency signals may be fed to antenna 54 (when transmitting) and may be received from antenna 54 (when receiving) using signal terminal 60 and ground terminal 62. In a typical arrangement, a coaxial conductor or other transmission line has its center conductor electrically connected to point 60 and its ground conductor electrically connected to point 62.

Figure 6:
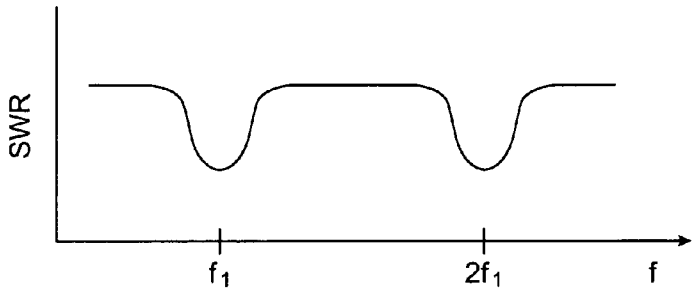
FIG. 6 is an illustrative antenna performance graph for an antenna of the type shown in FIGS. 4 and 5 in which standing-wave-ratio (SWR) values are plotted as a function of operating frequency.

A graph of the expected performance of antenna 54 of FIGS. 4 and 5 is shown in FIG. 6. Expected standing wave ratio (SWR) values are plotted as a function of frequency. As shown, there is a reduced SWR value at frequency $f_1$, indicating that the antenna performs well in the frequency band centered at frequency $f_1$. Antenna 54 also operates at harmonic frequencies such as frequency $2f_1$. The dimensions of antenna 54 may be selected so that frequencies $f_1$ and $2f_1$ are aligned with a communication bands of interest. The frequency $f_1$ (and harmonic frequency $2f_1$) are related to the length L of antenna 54 in dimension 66 (L is approximately equal to one quarter of a wavelength at frequency $f_1$).

The height H of antenna 54 of FIGS. 4 and 5 in dimension 64 is limited by the amount of near-field coupling between resonating element 54-1 and ground plane 54-2. For a specified antenna bandwidth and gain, it is not possible to reduced the height H without adversely affecting performance. All other variables being equal, reducing height H will cause the bandwidth and gain of antenna 54 to be reduced.

Figure 7:
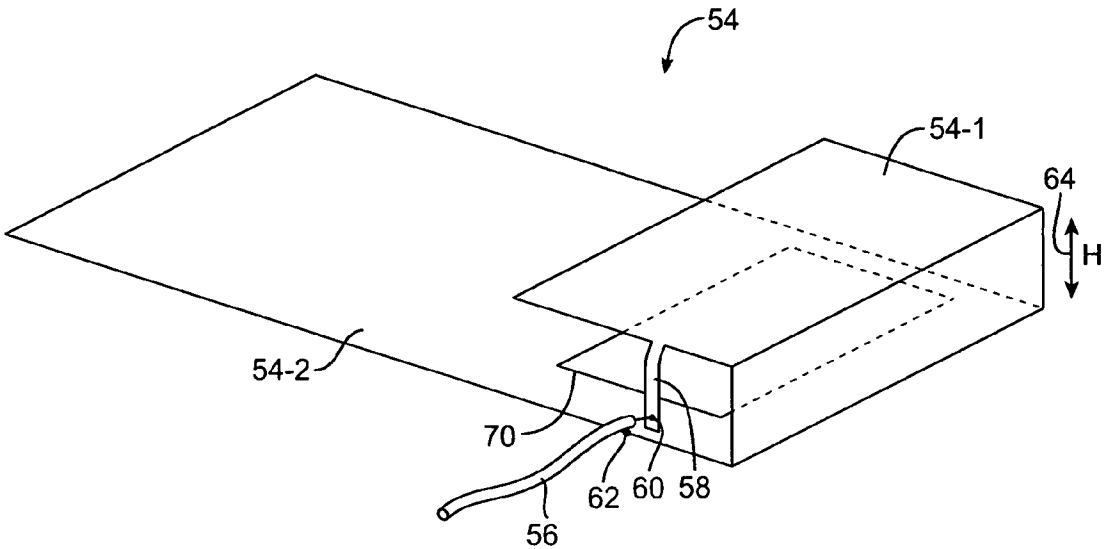
FIG. 7 is a perspective view of an illustrative planar inverted-F antenna in which a portion of the antenna's ground plane underneath the antenna's resonating element has been removed in accordance with an embodiment of the present invention.

As shown in FIG. 7, the minimum vertical dimension of antenna 54 can be reduced while still satisfying minimum bandwidth and gain constraints by introducing a dielectric region 70 in the area under antenna resonating element portion 54-1. The dielectric region 70 may be filled with air, plastic, or any other suitable dielectric and represents a cutaway or removed portion of ground plane 54-2. Removed or empty region 70 may be formed from one or more holes in ground plane 54-2. These holes may be square, circular, oval, polygonal, etc. and may extend though adjacent conductive structures in the vicinity of ground plane 54-2. With one suitable arrangement, which is shown in FIG. 7, the removed region 70 is rectangular and forms a slot. The slot may be any suitable size. For example, the slot may be slightly smaller than the outermost rectangular outline of resonating element 54-1. Typical resonating element lateral dimensions are on the order of 0.5 cm to 10 cm.

The presence of slot 70 reduces near-field electromagnetic coupling between resonating element 54-1 and ground plane 54-2 and allows height H in vertical dimension 64 to be made smaller than would otherwise be possible while satisfying a given set of bandwidth and gain constraints. For example, height H may be in the range of 1-5 mm, may be in the range of 2-5 mm, may be in the range of 2-4 mm, may be in the range of 1-3 mm, may be in the range of 1-4 mm, may be in the range of 1-10 mm, may be lower than 10 mm, may be lower than 4 mm, may be lower than 3 mm, may be lower than 2 mm, or may be in any other suitable range of vertical displacements above ground plane element 54-2.

If desired, the portion of antenna 54 that contains slot 70 may be used to form a slot antenna. The slot antenna structure in antenna 54 may be used at the same time as the PIFA structure. Antenna performance can be improved when operating antenna 54 so that both its PIFA operating characteristics and its slot antenna operating characteristics are obtained.

Figure 8:
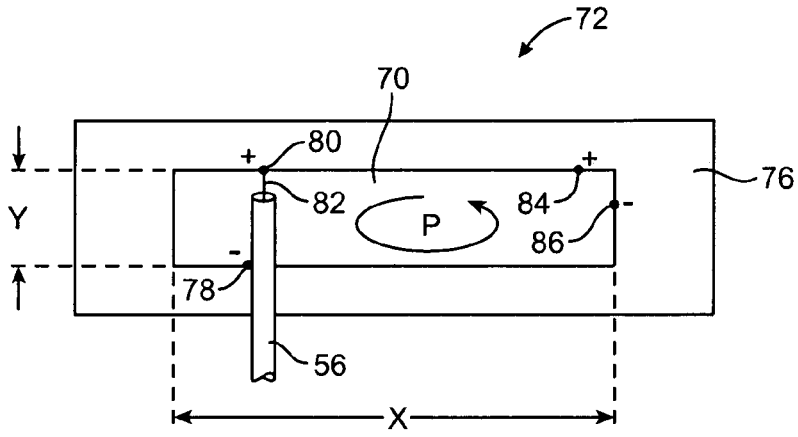
FIG. 8 is a top view of an illustrative slot antenna in accordance with an embodiment of the present invention.

A top view of a slot antenna 72 is shown in FIG. 8. The antenna 72 of FIG. 8 is typically thin in the dimension into the page (i.e., antenna 72 is planar with its plane lying in the page). A slot 70 is formed in the center of antenna 72. A coaxial cable 56 or other transmission line path may be used to feed antenna 72. In the example of FIG. 8, antenna 72 is fed so that the center conductor 82 of coaxial cable 56 is connected to signal terminal 80 (i.e., the positive or feed terminal of antenna 72) and the outer braid of coaxial cable 56, which forms the ground conductor for cable 56, is connected to ground terminal 78.

Figure 9:
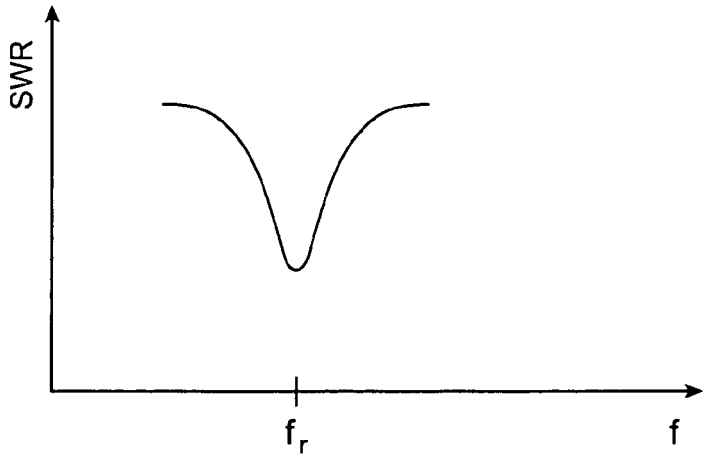
FIG. 9 is an illustrative antenna performance graph for an antenna of the type shown in FIG. 8 in which standing-wave-ratio (SWR) values are plotted as a function of operating frequency.

When antenna 72 is fed using the arrangement of FIG. 8, the antenna's performance is given by the graph of FIG. 9. As shown in FIG. 9, antenna 72 operates in a frequency band that is centered about center frequency $f_r$. The center frequency $f_r$ is determined by the dimensions of slot 70. Slot 70 has an inner perimeter P that is equal to two times dimension X plus two times dimension Y (i.e., P=2X+2Y). At center frequency $f_r$, perimeter P is equal to one wavelength. The position of terminals 80 and 78 is selected for impedance matching. If desired, terminals such as terminals 84 and 86, which extend around one of the corners of slot 70 may be used to feed antenna 72, provided that the distance between terminals 84 and 86 is chosen to properly adjust the impedance of antenna 72. In the illustrative arrangement of FIG. 8, terminals 84 and 86 are shown as being respectively configured as a slot antenna ground terminal and a slot antenna signal terminal, as an example. If desired, terminal 84 could be used as a ground terminal and terminal 86 could be used as a signal terminal. Slot 70 is typically air-filled, but may, in general, by filled with any suitable dielectric.

Figure 10:
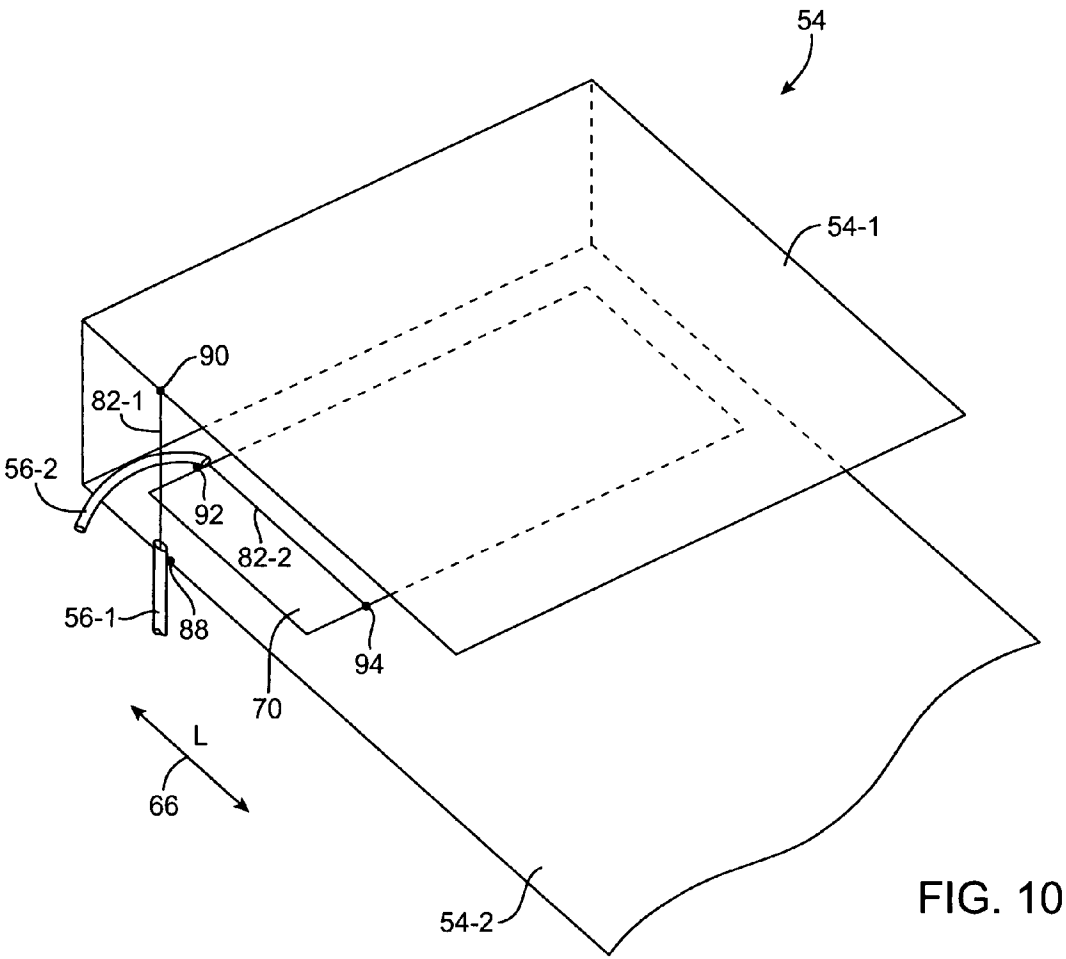
FIG. 10 is a perspective view of an illustrative planar inverted-F antenna in which a portion of the antenna's ground plane underneath the antenna's resonating element has been removed and in which the antenna is shown as being fed by two coaxial cable feeds in accordance with an embodiment of the present invention.

An illustrative configuration in which antenna 54 is fed using two coaxial cables (or other transmission lines) is shown in FIG. 10. When antenna 54 is fed as shown in FIG. 10, both the PIFA and slot antenna portions of antenna 54 are active. As a result, antenna 54 of FIG. 10 operates in a hybrid PIFA/slot mode. Coaxial cables 56-1 and 56-2 have inner conductors 82-1 and 82-2, respectively. Coaxial cables 56-1 and 56-2 also each have a conductive outer braid ground conductor. The outer braid conductor of coaxial cable 56-1 is electrically shorted to ground plane 54-2 at ground terminal 88. The ground portion of cable 56-2 is shorted to ground plane 54-2 at ground terminal 92. The signal connections from coaxial cables 56-1 and 56-2 are made at signal terminals 90 and 94, respectively.

With the arrangement of FIG. 10, two separate sets of antenna terminals are used. Coaxial cable 56-1 feeds the PIFA portion of antenna 54-1 using ground terminal 88 and signal terminal 90 and coaxial cable 56-2 feeds the slot antenna portion of antenna 54 using ground terminal 92 and signal terminal 94. Each set of antenna terminals therefore operates as a separate feed for the antenna. Signal terminal 90 and ground terminal 88 serve as antenna feed points for the PIFA portion of antenna 54, whereas signal terminal 94 and ground terminal 92 serve as antenna feed points for the slot portion of antenna 54. These two separate antenna feeds allow the antenna 54 to function simultaneously using both its PIFA and its slot characteristics. If desired, the orientation of the feeds can be changed. For example, coaxial cable 56-2 may be connected to slot 70 using point 94 as a ground terminal and point 92 as a signal terminal or using ground and signal terminals located at other points along the periphery of slot 70.

Each coaxial cable or other transmission line may terminate at a respective transceiver circuit (also sometimes referred to as a radio) or coaxial cables 56-1 and 56-2 (or other transmission lines) may be connected to switching circuitry that, in turn is connected to one or more radios. When antenna 54 is operated in hybrid PIFA/slot antenna mode, the frequency coverage of antenna 54 and/or its gain at particular frequencies can be enhanced.

Figure 11:
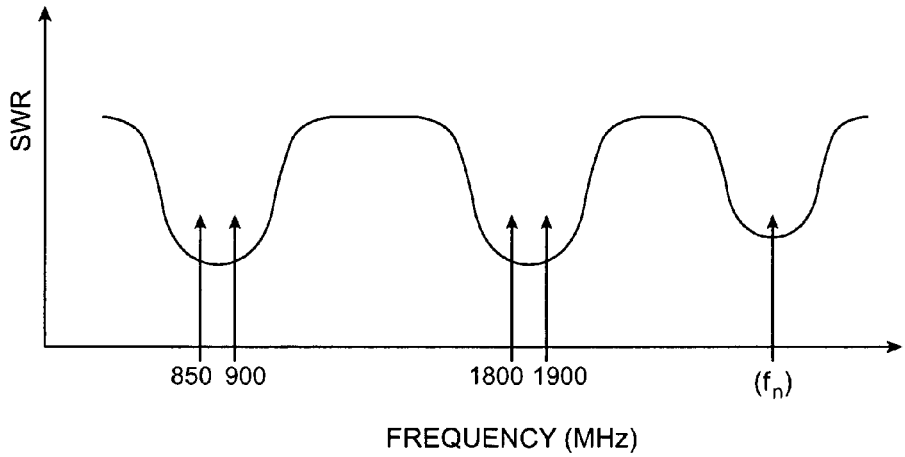
FIG. 11 is a graph of an illustrative antenna performance graph for an antenna of the type shown in FIG. 10 in which standing-wave-ratio (SWR) values are plotted as a function of operating frequency.

With one suitable arrangement, the additional response provided by the slot antenna portion of antenna 54 is used to cover one or more additional frequency bands. By proper selection of the dimensions of slot 70 and length L of ground plane 54-2 in dimension 66, antenna 54 can cover the GSM cellular telephone bands at 850 and 900 MHz and at 1800 and 1900 MHz and can cover an additional band centered at frequency $f_n$ (as an example). A graph showing the performance of antenna 54 of FIG. 10 is shown in FIG. 11. In the example of FIG. 11, the PIFA operating characteristics of antenna 54 are used to cover the 850/900 and the 1800/1900 GSM cellular telephone bands, whereas the slot antenna operating characteristics of antenna 54 are used to cover the frequency band centered at $f_n$. This arrangement provides more coverage than would otherwise be possible, while minimizing the size of antenna 54. The frequency $f_n$ may be adjusted to coincide with any suitable frequency band of interest (e.g., 2.4 GHz for Bluetooth/WiFi, 2170 MHz for UMTS, or 1550 MHz for GPS).

Figure 12:
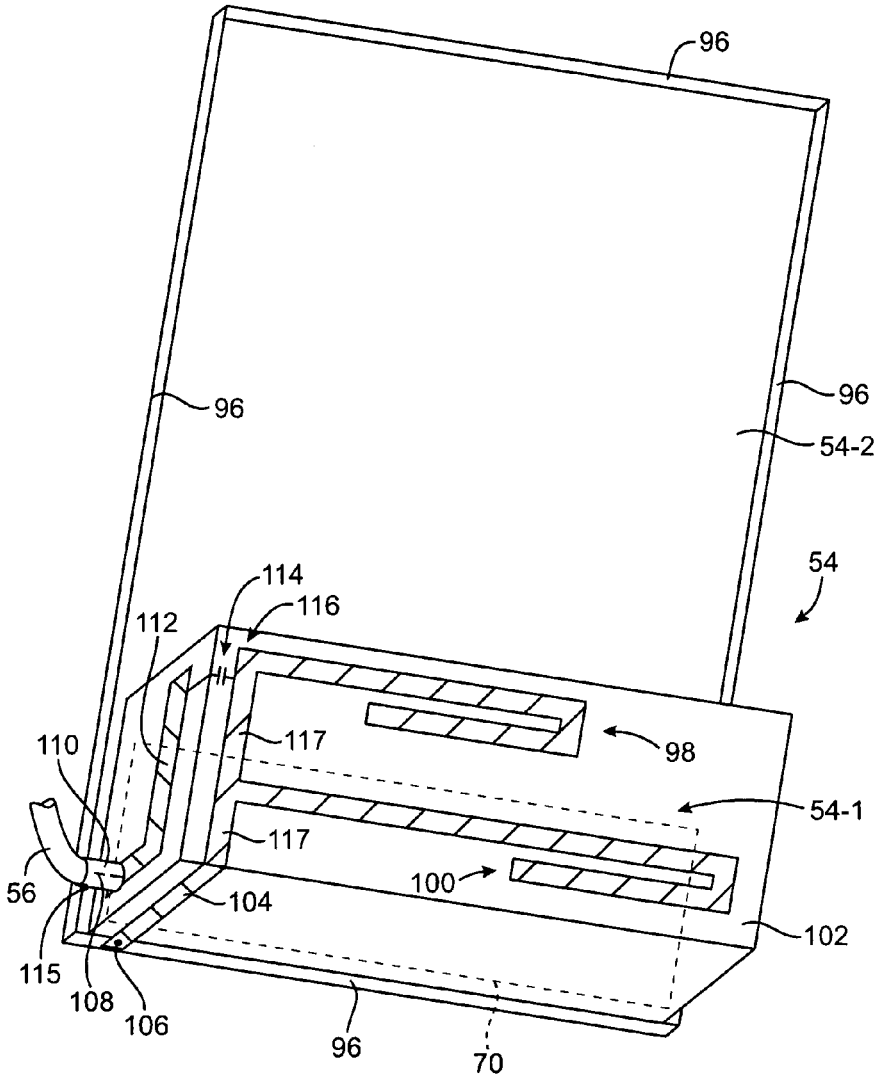
FIG. 12 is a perspective view of an illustrative antenna that has both PIFA and slot antenna characteristics in accordance with an embodiment of the present invention.

If desired, antenna 54 may be fed using a single coaxial cable 56 or other such transmission line. An illustrative configuration for antenna 54 in which a single transmission line is used to simultaneously feed both the PIFA portion and the slot portion of antenna 54 is shown in FIG. 12. As shown in FIG. 12, antenna 54 has a ground plane 54-2. Ground plane 54-2 may be formed from metal (as an example). Edges 96 of ground plane 54-2 may be formed by bending the metal of ground plane 54-2 upward. When inserted into housing 12, edges 96 may rest within the sidewalls of metal housing portion 12-1 (FIG. 3). If desired, ground plane 54-2 may be formed using one or more metal layers in a printed circuit board, metal foil, or other suitable conductive structures.

Planar antenna resonating element 54-1 is an F-shaped structure having shorter arm 98 and longer arm 100. The lengths of arms 98 and 100 may be adjusted to tune the frequency coverage of antenna 54. If desired, antenna 54 of FIG. 12 could use a planar resonating element structure of the type shown in FIG. 4 or other suitable resonating element structure. The use of a PIFA antenna resonating element structure that is formed with two arms 98 and 100 is shown as an example.

Arms 98 and 100 are mounted on a support structure 102. Support structure 102 may be formed from plastic (e.g., ABS plastic) or other suitable dielectric. The surfaces of structure 102 may be flat or curved. Arms 98 and 100 may be formed directly on support structure 102 or may be formed on a separate structure such as a flex circuit substrate that is attached to support structure 102 (as examples).

With one suitable arrangement, resonating element 54-1 is a substantially planar structure that is mounted to an upper surface of support 102. Resonating element 54-1 may be formed by any suitable antenna fabrication technique such as metal stamping, cutting, etching, or milling of conductive tape or other flexible structures, etching metal that has been sputter-deposited on plastic or other suitable substrates, printing from a conducive slurry (e.g., by screen printing techniques), patterning metal such as copper that makes up part of a flex circuit substrate that is attached to support 102 by adhesive, screws, or other suitable fastening mechanisms, etc.

A conductive path such as conductive strip 104 may be used electrically connect the resonating element 54-1 to ground plane 54-2 at terminal 106. A screw or other fastener at terminal 106 may be used to electrically and mechanically connect strip 104 (and therefore resonating element 54-1) to edge 96 of ground plane 54-2. Conductive structures such as strip 104 and other such structures in antenna 54 may also be electrically connected to each other using conductive adhesive.

A coaxial cable such as cable 56 or other transmission line may be connected to the antenna to transmit and receive radio-frequency signals. The coaxial cable or other transmission line may be connected to the structures of antenna 54 using any suitable electrical and mechanical attachment mechanism. As shown in the illustrative arrangement of FIG. 12, mini UFL coaxial connector 110 may be used to connect coaxial cable 56 or other transmission lines to antenna conductor 112. A center conductor of the coaxial cable or other transmission line is connected to center connector 108 of connector 110. The outer braid ground conductor of the coaxial cable is electrically connected to ground plane 54-2 via connector 110 at point 115 (and, if desired, may be shorted to ground plane 54-2 at other attachment points upstream of connector 110).

Conductor 108 may be electrically connected to antenna conductor 112. Conductor 112 may be formed from a conductive element such as a strip of metal formed on a sidewall surface of support structure 102. Conductor 112 may be directly electrically connected to resonating element 54-1 (e.g., at portion 116) or may be electrically connected to resonating element 54-1 through tuning capacitor 114 or other suitable electrical components. The size of tuning capacitor 114 can be selected to tune antenna 54 and ensure that antenna 54 covers the frequency bands of interest for device 10.

Slot 70 may lie beneath resonating element 54-1 of FIG. 12. The signal from center conductor 108 may be routed to point 106 on ground plane 54-2 in the vicinity of slot 70 using a conductive path formed from antenna conductor 112, optional capacitor 114 or other such tuning components, antenna conductor 117, and antenna conductor 104.

The configuration of FIG. 12 allows a single coaxial cable or other transmission line path to simultaneously feed both the PIFA portion and the slot portion of antenna 54.

Grounding point 115 functions as the ground terminal for the slot antenna portion of antenna 54 that is formed by slot 70 in ground plane 54-2. Point 106 serves as the signal terminal for the slot antenna portion of antenna 54. Signals are fed to point 106 via the path formed by conductive path 112, tuning element 114, path 117, and path 104.

For the PIFA portion of antenna 54, point 115 serves as antenna ground. Center conductor 108 and its attachment point to conductor 112 serve as the signal terminal for the PIFA. Conductor 112 serves as a feed conductor and feeds signals from signal terminal 108 to PIFA resonating element 54-1.

In operation, both the PIFA portion and slot antenna portion of antenna 54 contribute to the performance of antenna 54.

The PIFA functions of antenna 54 are obtained by using point 115 as the PIFA ground terminal (as with terminal 62 of FIG. 7), using point 108 at which the coaxial center conductor connects to conductive structure 112 as the PIFA signal terminal (as with terminal 60 of FIG. 7), and using conductive structure 112 as the PIFA feed conductor (as with feed conductor 58 of FIG. 7). During operation, antenna conductor 112 serves to route radio-frequency signals from terminal 108 to resonating element 54-1 in the same way that conductor 58 routes radio-frequency signal from terminal 60 to resonating element 54-1 in FIGS. 4 and 5, whereas conductive line 104 serves to terminate the resonating element 54-1 to ground plane 54-2, as with grounding portion 61 of FIGS. 4 and 5.

The slot antenna functions of antenna 54 are obtained by using grounding point 115 as the slot antenna ground terminal (as with terminal 86 of FIG. 8), using the conductive path formed of antenna conductor 112, tuning element 114, antenna conductor 117, and antenna conductor 104 as conductor 82 of FIG. 8 or conductor 82-2 of FIG. 10, and by using terminal 106 as the slot antenna signal terminal (as with terminal 84 of FIG. 8).

The configuration of FIG. 10 shows that slot antenna ground terminal 92 and PIFA antenna ground terminal 88 may be formed at separate locations on ground plane 54-2. In the configuration of FIG. 12, a single coaxial cable may be used to feed both the PIFA portion of the antenna and the slot portion of the antenna. This is because terminal 115 serves as both a PIFA ground terminal for the PIFA portion of antenna 54 and a slot antenna ground terminal for the slot antenna portion of antenna 54. Because the ground terminals of the PIFA and slot antennas are provided by a common ground terminal structure and because conductive paths 112, 117, and 104 serve to distribute radio-frequency signals to and from the resonating element 54-1 and ground plane 54-2 as needed for PIFA and slot antenna operations, a single transmission line (e.g., coaxial conductor 56) may be used to send and receive radio-frequency signals that are transmitted and received using both the PIFA and slot portions of antenna 54.

If desired, other antenna configurations may be used that support hybrid PIFA/slot operation. For example, the radio-frequency tuning capabilities of tuning capacitor 114 may be provided by a network of other suitable tuning components, such as one or more inductors, one or more resistors, direct shorting metal strip(s), capacitors, or combinations of such components. One or more tuning networks may also be connected to the antenna at different locations in the antenna structure. These configurations may be used with single-feed and multiple-feed transmission line arrangements.

Moreover, the location of the signal terminal and ground terminal in antenna 54 may be different from that shown in FIG. 12. For example, terminals 115/108 and terminal 106 can be moved relative to the locations shown in FIG. 12, provided that the connecting conductors 112, 117, and 104 are suitably modified.

The PIFA portion of antenna 54 can be provided using a substantially rectangular conductor as shown in FIG. 10, or can be provided using other arrangements. For example, resonating element 54-1 may be formed from a non-rectangular planar structure, from a planar structure with a rectangular outline that has one or more serpentine conductive structures within the rectangular outline, or from a slotted non-rectangular or slotted rectangular planar structure. If desired, resonating element 54-1 may be provided with a substantially F-shaped conductive element having one or more arms such as arms 98 and 100 of FIG. 12. Such resonating element arms may be straight, serpentine, curved, or may have any other suitable shape. Use of different shapes for the arms or other portions of resonating element 54-1 helps antenna designers to tailor the frequency response of antenna 54 to its desired frequencies of operation and to otherwise optimize antenna performance. The sizes of the structures in resonating element 54-1 can be adjusted as needed (e.g., to increase or decrease gain and/or bandwidth for a particular operating band). Arms of dissimilar sizes (lengths) tend to affect the resonance behavior of antenna 54 at different frequencies and may therefore be advantageous when tuning multiple frequency bands of interest.

Figure 13:
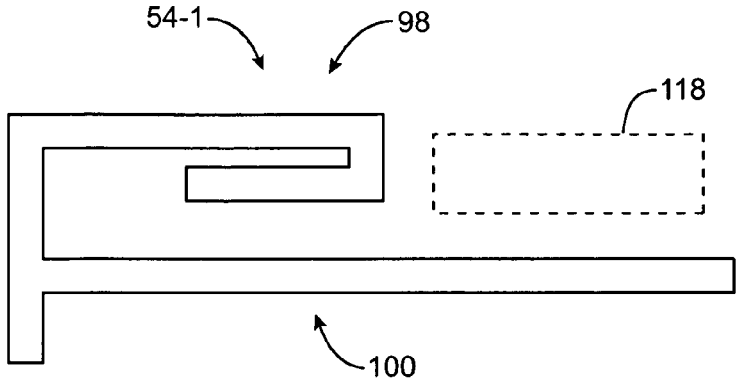
FIGS. 13, 14, and 15 are top views of illustrative multi-arm PIFA resonating element portions for a hybrid PIFA-slot antenna in accordance with an embodiment of the present invention.

An illustrative resonating element 54-1 in which arm 98 is formed from a folded-over structure and arm 100 is formed from a straight strip of conductor is shown in FIG. FIG. 13. This type of arrangement may be advantageous when it is desired to place additional structures in region 118.

Figure 14:
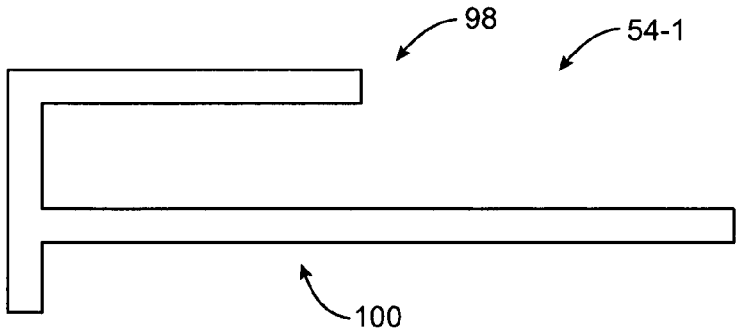

In the example of FIG. 14, both arm 98 and arm 100 are formed without bends. This type of structure may be used for resonating element 54-1 when there is sufficient lateral space for forming arms 98 and 100.

Figure 15:
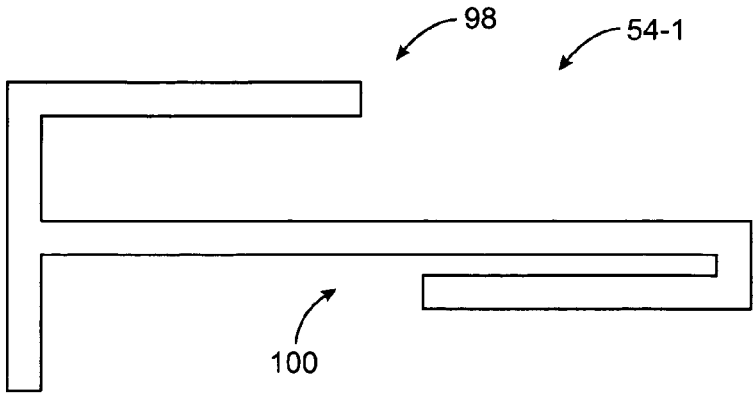

Another illustrative configuration for antenna resonating element 54-1 is shown in FIG. 15. In the example of FIG. 15, arm 98, which is the shorter of the two arms, is formed without any bends. Arm 100, which is the longer of the two arms, is formed with a single bend. If desired, arms 98 and 100 may be formed with no bends, with one bend, or with more than one bend. The bends may be 180° bends (e.g., where an arm doubles back on itself), may be 90° bends, or may be bends formed at any other suitable angle to the longitudinal axis of the arm. Arrangements of the type shown in FIGS. 12, 13, and 15 in which the arms contain bends that reverse the direction of the conductive arm element are shown as examples.

The foregoing is merely illustrative of the principles of this invention and various modifications can be made by those skilled in the art without departing from the scope and spirit of the invention.

What is claimed is:

1. A handheld electronic device antenna comprising:

a ground plane that surrounds and encloses a dielectric-filled slot;

a planar resonating element located above the slot, wherein the handheld electronic antenna comprises a hybrid antenna in which the slot is used in forming a slot antenna portion of the hybrid antenna and in which the planar resonating element is used in forming a planar-inverted-F antenna portion of the hybrid antenna;

a first signal terminal that is electrically coupled to the planar resonating element;

a first ground terminal that is electrically connected to the ground plane, wherein the first signal terminal and first ground terminal serve as antenna feed points for the planar-inverted-F antenna portion of the hybrid antenna;

a second signal terminal that is electrically connected to the ground plane adjacent to the slot; and a second ground terminal that is electrically connected to the ground plane adjacent to the slot, wherein the second signal terminal is different than the first signal terminal, wherein the second ground terminal is different than the first ground terminal, and wherein the second signal terminal and the second ground terminal serve as antenna feed points for the slot antenna portion of the hybrid antenna.

2. The handheld electronic device antenna defined in claim 1 wherein the slot comprises a rectangular slot having lateral dimensions, wherein the planar resonating element has at least one lateral dimension larger than the lateral dimensions of the slot, and wherein the planar resonating element is located less than 10 mm above the slot.

3. The handheld electronic device antenna defined in claim 1 wherein the planar resonating element comprises a conductor formed on a flex circuit substrate.

4. A hybrid handheld electronic device antenna with characteristics of both a planar inverted-F antenna structure and a slot antenna structure, comprising:

a ground plane antenna element, wherein portions of the ground plane antenna element define a closed dielectric-filled slot associated with the slot antenna structure and wherein the ground plane antenna element surrounds and encloses the closed slot;

a planar antenna resonating element that is located above the closed slot and that is associated with the planar inverted-F antenna structure; and a first pair of antenna terminals through which a first transmission line conveys radio-frequency signals for the slot antenna structure; and a second pair of antenna terminals through which a second transmission line that is different than the first transmission line conveys radio-frequency signals for the planar inverted-F antenna structure.

5. The hybrid handheld electronic device antenna defined in claim 4 wherein the planar resonating element comprises at least two arms and wherein at least one of the arms has a bend.

6. The hybrid handheld electronic device antenna defined in claim 4 wherein the planar resonating element comprises two arms and wherein each of the two arms has at least a 180° bend.

7. A wireless handheld electronic device comprising:

storage that stores data;

processing circuitry coupled to the storage that generates data for wireless transmission and that processes wirelessly received data; and wireless communications circuitry, wherein the wireless communications circuitry comprises transceiver circuitry, an antenna, and a transmission line, wherein the transmission line has a ground conductor and a signal conductor and conveys radio-frequency signals for the antenna between the transceiver circuitry and the antenna, wherein the antenna comprises a ground plane with a dielectric-filled slot and a planar resonating element located above the slot, and wherein the planar resonating element comprises a conductor formed on a flex circuit substrate, wherein the antenna comprises a hybrid antenna in which the slot in the ground plane is used in forming a slot antenna portion of the hybrid antenna and in which the planar resonating element is used in forming a planar-inverted-F antenna portion of the hybrid antenna, and wherein the hybrid antenna comprises:

a first terminal connected to the signal conductor;

a ground terminal that is electrically connected to the ground plane and the ground conductor;

a first antenna conductive path that electrically connects the first terminal to the planar resonating element so that the first terminal and the ground terminal serve as antenna feed points for the planar-inverted-F portion of the hybrid antenna;

a second terminal that is connected to the ground plane at a location different from the ground terminal; and a second antenna conductive path that is electrically connected to the second terminal, wherein the first antenna conductive path and the second antenna conductive path convey signals between the signal conductor and the second terminal so that the ground terminal and the second terminal serve as antenna feed points for the slot antenna portion of the hybrid antenna.

8. The wireless handheld electronic device defined in claim 7 wherein the planar resonating element comprises a first resonating element arm and a second resonating element arm, wherein the first resonating element arm has a length, and wherein the second resonating element arm has a length that is different than the length of the first resonating element arm.

9. The wireless handheld electronic device defined in claim 7 further comprising a display coupled to the processing circuitry, wherein the wireless handheld electronic device comprises a device having music player capabilities.

10. A hybrid handheld electronic device antenna with characteristics of both a planar inverted-F antenna structure and a slot antenna structure, comprising:

a ground plane antenna element, wherein portions of the ground plane antenna element define a dielectric-filled slot associated with the slot antenna structure and wherein the ground plane antenna element completely encloses the slot; and a planar resonating element that is located above the slot and that is associated with the planar inverted-F antenna structure, wherein the planar resonating element comprises a conductor formed on a flex circuit substrate.

11. The hybrid handheld electronic device antenna defined in claim 10 further comprising:

a pair of antenna terminals through which a single transmission line conveys radio-frequency signals for both the planar inverted-F antenna structure and the slot antenna structure.

12. The hybrid handheld electronic device antenna defined in claim 10 further comprising:

a first pair of antenna terminals through which a first transmission line conveys radio-frequency signals for the slot antenna structure; and a second pair of antenna terminals through which a second transmission line that is different than the first transmission line conveys radio-frequency signals for the planar inverted-F antenna structure.

13. The hybrid handheld electronic device antenna defined in claim 10 wherein the planar resonating element comprises at least two arms and wherein at least one of the arms has a bend.

14. The hybrid handheld electronic device antenna defined in claim 10 wherein the planar resonating element comprises two arms and wherein each of the two arms has a 180° bend.

15. Wireless communications circuitry comprising:

an antenna comprising a ground plane element having portions that define a dielectric-filled slot for a slot antenna and comprising a planar resonating element located above the slot for a planar inverted-F antenna; and a connector having a ground terminal connected to the ground plane element at a first point and having a signal terminal, wherein the antenna comprises:

a first antenna path located between the signal terminal and the planar resonating element so that the ground terminal and the signal terminal serve as antenna feed terminals for the planar inverted-F antenna; and a second antenna path located between the planar resonating element and a second point on the ground plane element so that the ground terminal and the second point on the ground plane element serve as antenna feed terminals for the slot antenna.

16. The wireless communications circuitry defined in claim 15 further comprising:

a wireless transceiver circuit; and at least one coaxial cable connected between the wireless transceiver circuit and the connector, wherein the coaxial cable has an outer ground conductor connected to the ground terminal and has a signal conductor connected to the signal terminal.

17. The wireless communications circuitry defined in claim 15 further comprising:

a wireless transceiver circuit; and at least one transmission line connected between the wireless transceiver circuit and the connector, wherein the transmission line has a ground conductor connected to the ground terminal and has a signal conductor connected to the signal terminal.

18. The wireless communications circuitry defined in claim 15 further comprising at least one wireless transceiver circuit that transmits and receives radio-frequency signals through the antenna using a coaxial cable.

19. The wireless communications circuitry defined in claim 15 further comprising a dielectric antenna support structure having a surface on which at least part of the planar resonating element is mounted, wherein the first antenna path and the second antenna path are supported by the dielectric antenna support structure.

20. The wireless communications circuitry defined in claim 15 further comprising at least one tuning element, wherein the slot is substantially rectangular, wherein the first antenna path and the second antenna path comprise strips of metal that are connected through the tuning element, and wherein the planar resonating element comprises two arms.

21. An antenna for use in a handheld device, comprising:

a ground plane, wherein portions of the ground plane define a dielectric-filled slot;

a planar resonating element that is located above the slot, wherein the slot forms a slot antenna portion of the antenna and wherein the planar resonating element forms a planar-inverted-F antenna portion of the antenna;

positive and ground antenna terminals that convey radio-frequency signals between the antenna and radio-frequency transceiver circuitry;

a first antenna path that conveys signals between the positive antenna terminal and the planar resonating element so that the positive and ground antenna terminals form antenna feed terminals for the planar inverted-F antenna portion of the antenna; and a second antenna path that conveys signals between the planar resonating element and the ground plane at a point on the ground plane adjacent to the slot so that the point on the ground plane and the ground antenna terminal serve as antenna feed terminals for the slot antenna portion of the antenna.

22. The antenna defined in claim 21 wherein the ground plane surrounds and encloses the slot.

23. The antenna defined in claim 21 wherein the planar resonating element comprises a flex circuit, the antenna further comprising a dielectric antenna support structure having a surface on which at least part of the planar resonating element is mounted, wherein the first antenna path and the second antenna path are supported by the dielectric antenna support structure and are formed as part of the flex circuit.

24. The antenna defined in claim 21 further comprising at least one capacitor in the first antenna path.

* * * * *